US009027209B2

(12) United States Patent
Blackford et al.

(10) Patent No.: US 9,027,209 B2
(45) Date of Patent: May 12, 2015

(54) SNAG RESISTANT SLIDE FASTENER

(75) Inventors: Michael "Woody" Blackford, Portland, OR (US); Gary Davis, Oxford, NC (US); Paul Blalock, Oxford, NC (US)

(73) Assignee: Columbia Sportswear North America, Inc., Portland, OR (US)

( * ) Notice: Subject to any disclaimer, the term of this patent is extended or adjusted under 35 U.S.C. 154(b) by 129 days.

(21) Appl. No.: 12/697,118

(22) Filed: Jan. 29, 2010

(65) Prior Publication Data

US 2010/0192332 A1 Aug. 5, 2010

Related U.S. Application Data

(60) Provisional application No. 61/148,749, filed on Jan. 30, 2009.

(51) Int. Cl.
*A44B 19/26* (2006.01)
*A44B 19/34* (2006.01)

(52) U.S. Cl.
CPC ..... *A44B 19/26* (2013.01); *Y10T 24/2588* (2015.01); *Y10T 24/258* (2015.01); *Y10T 24/2586* (2015.01); *A44B 19/265* (2013.01); *A44B 19/34* (2013.01)

(58) Field of Classification Search
CPC ..... A44B 19/26; A44B 19/265; A44B 19/34; Y10T 24/258; Y10T 24/2586; Y10T 24/2588
USPC ..... 24/426–427, 429–431, 415, 419, 422, 24/381
See application file for complete search history.

(56) References Cited

U.S. PATENT DOCUMENTS

| | | | | |
|---|---|---|---|---|
| 1,681,550 | A | 8/1928 | Marinsky | |
| 1,886,123 | A * | 11/1932 | Rust | 24/426 |
| 2,176,445 | A * | 10/1939 | L Amie | 24/426 |
| 2,295,976 | A * | 9/1942 | Suskowitz et al. | 24/426 |
| 2,405,883 | A * | 8/1946 | Gould | 24/422 |
| 2,819,505 | A * | 1/1958 | Marcellus | 24/426 |
| 2,855,652 | A * | 10/1958 | Jones | 24/426 |
| 2,933,792 | A * | 4/1960 | Malmborg | 24/426 |
| 3,497,926 | A * | 3/1970 | Frohlich | 24/427 |
| 4,570,309 | A * | 2/1986 | Ishii | 24/429 |
| 4,624,032 | A * | 11/1986 | Ishii et al. | 24/429 |
| 4,829,638 | A * | 5/1989 | Ishii | 24/421 |
| 4,982,479 | A | 1/1991 | Oda | |
| 6,490,770 | B1 * | 12/2002 | Matsuda et al. | 24/428 |
| 7,219,402 | B2 * | 5/2007 | Yamazaki | 24/429 |
| 7,257,868 | B2 | 8/2007 | Yoneshima | |

(Continued)

FOREIGN PATENT DOCUMENTS

| | | |
|---|---|---|
| EP | 1201144 A2 | 5/2002 |
| JP | S49-2641 | 1/1974 |
| JP | S58-98808 | 7/1983 |
| JP | 10-215921 | 8/1998 |

(Continued)

*Primary Examiner* — Robert J Sandy
*Assistant Examiner* — Abigail Morrell
(74) *Attorney, Agent, or Firm* — Schwabe, Williamson & Wyatt, P.C.

(57) ABSTRACT

Embodiments herein provide modified slider bodies with one or more features such as an elongated spring cap, a protrusion on the bottom plate and/or plate coupler of the slider body, and/or vertically offset side rails. These features may minimize introduction of loose fabric, such as the lining of a lined garment, into the tape slot of the slider body, thereby help reduce jamming of the slider body during operation of the slide fastener.

5 Claims, 14 Drawing Sheets

(56) References Cited

U.S. PATENT DOCUMENTS

| | | | | |
|---|---|---|---|---|
| 7,293,334 | B2 * | 11/2007 | Metzger | 24/415 |
| 2002/0108218 | A1 | 8/2002 | Chen | |
| 2003/0192151 | A1 * | 10/2003 | Metzger | 24/415 |
| 2004/0231115 | A1 | 11/2004 | Keyaki et al. | |
| 2007/0022579 | A1 * | 2/2007 | Akashi et al. | 24/386 |
| 2008/0229555 | A1 * | 9/2008 | Keyaki et al. | 24/429 |

FOREIGN PATENT DOCUMENTS

| | | |
|---|---|---|
| JP | 2002-136310 | 5/2002 |
| JP | 2007-296288 | 11/2007 |
| KR | 20-0399894 | 10/2005 |
| RU | 2033063 C1 | 4/1995 |
| TW | M306795 | 3/2007 |
| WO | WO2009134438 | 5/2009 |

* cited by examiner

SNAG RESISTANT SLIDE FASTENER

CROSS REFERENCE TO RELATED APPLICATIONS

The present application claims priority to U.S. Patent Application No. 61/148,749, filed Jan. 30, 2009, titled "Snag Resistant Slide Fastener," the disclosure of which is hereby incorporated by reference in its entirety.

TECHNICAL FIELD

Embodiments herein relate to the field of fasteners, and, more specifically, to a slide fastener slider body with one or more features to minimize jamming of materials within the slider body during operation of a slide fastener.

BACKGROUND

Jackets and other outerwear often incorporate a fabric liner. The liner may be part of a multi-fabric sandwich or a separate piece of fabric. Liners serve many purposes including to enhance the inside appearance of a garment and to enhance the wearability of the garment. Liner fabrics are typically thin materials, and are sized slightly larger than the lined material for some amount of "give". This characteristic makes liners prone to bunching, and such bunching typically occurs near trimmings such as slide fasteners or zippers, thereby resulting in snagging.

Snagging also is common in Jackets and other outerwear made from heavier fabrics that use a heavier zipper. Heavier zippers have larger sliders that are more prone to snag a garment liner. In addition, lined jackets that include a stretchable waist band are particularly prone to snags since the liner has to be loose enough to accommodate the maximum stretch allowed in the waist band. Other garments may be composed of very light weight fabrics, or may include decorative elements made from light weight fabrics. Such light weight fabrics can similarly become enmeshed in the slider body of a slide fastener, causing jams.

There are numerous types of zippers, with a wide variety of sliders, used throughout the garment, equipment, and accessory industries. Typical slide fasteners comprise metal zippers, molded zippers, and coil-type zippers. In each case, the zippers used in various products (garments, outdoor/camping equipment, bags, etc.) tend to be of a larger size such as a number 5, 6, or 7. While the larger size does not itself make a slider more prone to jams, the larger size sliders have larger openings into which fabric can wedge.

Conventional zippers are also prone to snagging due to the geometry of the slider (the size of the throat openings, the tight tolerances between the side rails and the zipper teeth, the overall tolerances between the throat openings and the size of the zipper teeth), and the rotation imparted to the slider body when the pull tab is pulled to close the zipper. This rotation causes the slider body to rotate towards the liner fabric, and therefore increases the likelihood of a snag. While this rotation is less pronounced with a larger size zipper, as mentioned above, the larger size is more prone to snagging because of the larger openings in the slider body.

BRIEF DESCRIPTION OF THE DRAWINGS

Embodiments will be readily understood by the following detailed description in conjunction with the accompanying drawings. Embodiments are illustrated by way of example and not by way of limitation in the figures of the accompanying drawings.

DETAILED DESCRIPTION OF DISCLOSED EMBODIMENTS

Figure 1:
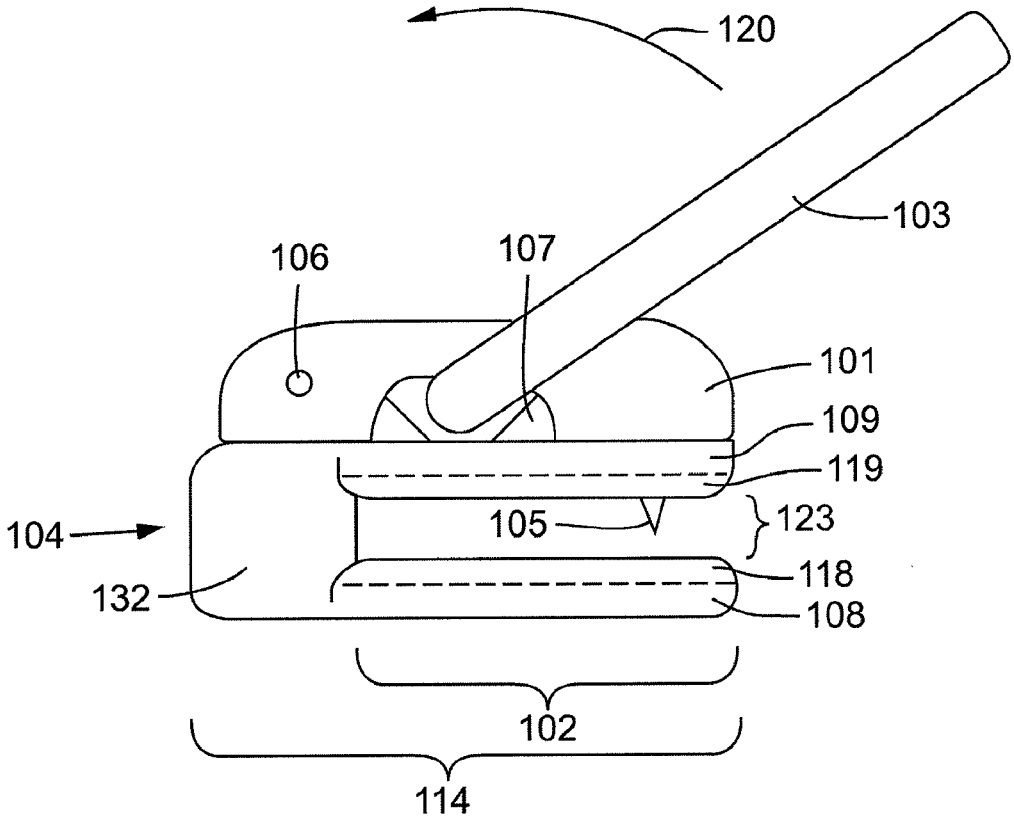
FIG. 1 (PRIOR ART)
FIG. 1 illustrates a side view of a conventional slider body showing the pull tab in an operating position and a locking pin in the locked position.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous.

As used herein, "zipper tape" may be used to refer to the stringers and the interlocking teeth/coils of a slide fastener, which are coupled in rows to each of two stringers. "Zipper teeth elements" may be used to refer to any interlocking element of a slide fastener (e.g. teeth, coils). "Slider body" may be used to refer to the movable slide fastener component coupled to the zipper tape and operable for opening and closing the slide fastener. "Tape slot" is defined herein as the space or gap between the top surface of a bottom side rail and the bottom surface of a top side rail. A "flanking region" is defined herein to include the space between the top surface of a bottom side rail and the bottom surface of the top plate, and the space between the bottom surface of a top side rail and the top surface of the bottom plate. A "flanking region" may be contiguous, connected, and/or in communication with a "tape slot".

As used herein, standard sizes (e.g. size 3, size 5, size 8, size 9.5, etc.) may be used in descriptions of embodiments of a modified slider body to indicate zipper tape size. These sizes are not used to describe the dimensions of a slider body or modified slider body. For example, the term "size 5 modified slider body" is used to herein to indicate that the described modified slider body is configured for use with a standard size 5 zipper tape. In some embodiments, a modified slider body may be configured for use with zipper tapes within a range of sizes. While the descriptions refer to standard sizes, embodiments may include modified slider bodies configured for use with zipper tapes of non-standard and/or custom sizes.

Embodiments herein provide a modified slider body configured to minimize jamming when used as a component of a zipper that is used in, for example, a lined garment, sleeping bag, or in any other application where loose fabric is in close proximity to the slide fastener and/or slider body during operation of the slide fastener. The geometry of various embodiments of a modified slider body described herein, as well as the means of operation of such a slider body by the wearer of a lined garment, may inhibit the liner (or other) fabric from entering the throat of the slider and thereby becoming jammed in the slider body. In embodiments, the geometry of a modified slider body may help divert or push loose fabric away from the joining length of the modified slider body, thereby resisting jamming during operation.

In some embodiments, a modified slider body may include one or more features to reduce the rotation of the slider body while the garment wearer pulls the pull tab to close the zipper. Reducing the rotation may reduce the proximity of the liner fabric to the zipper teeth near the slider body, thereby helping to minimize snagging. In other embodiments, a modified slider body may comprise one or more features such as a forward- and/or downward-protruding feature to push liner fabric away from the zipper teeth near the modified slider body opening. In still other embodiments, the geometry of the side rails of the modified slider body may be configured to enable the rails to push loose fabric away from the throat openings of the modified slider body. Various embodiments may include one or more of the above features in any combination, providing for a modified slider body suitably enabled to push materials away from the modified slider body opening and/or to reduce the rotation of the modified slider body when the pull tab is pulled during operation of the slider body.

In one embodiment of the present invention, a modified slider body may include a protrusion on the back plate of the slider body. Such a protrusion may comprise a separate element adhered to the flat plate back of a conventional slider body, or the protrusion and plate back/slider body may be molded/formed as a single unit/piece. The protrusion may be in the form of any number of shapes, including but not limited to a plow shape, a wing shape, an arc, and/or a simple half-barrel shape. It is recognized that a variety of shapes may be employed for the protrusion of the modified slider body disclosed herein.

In another embodiment of the present invention, the side rails of the top plate, the bottom plate, or some combination of both are shortened (in comparison to a conventional design where the rails are of equal length on both the top and bottom plates). It is recognized that a variety of differing lengths may accomplish the objective of the present invention.

In yet another embodiment of the present invention, a modified slider body may have an elongated joining length (as compared to a conventional slider body) in proportion to the width of the modified slider body, and/or the spring cap may be elongated. A pull tab of a conventional slider generally pivots around an axis that is within the lateral confines of the spring cap. The elongated slider cap of this embodiment allows the pull tab of a slide fastener with a modified slider body to translate along the length of the modified slider body, and to rotate as in a conventional slider cap, when the pull tab is pulled to open and close the slide fastener.

FIG. 1 illustrates a side view of a conventional slider body showing the pull tab in an operating position. The slider body 104 has a length 114, a portion of which comprises the joining length 102. The joining length 102 is the length of the portion of the slider body 104 from the rear of the post 132 (located within the interior of the slider body) to the rear of the slider body. This portion of the slider body includes a joining channel. When the slider body 104 is coupled to a zipper tape, moving the slider body along the zipper tape in a first direction pushes the post 132 against the interlocked zipper teeth elements of the zipper tape, separating the zipper teeth elements to open the slide fastener. Moving the slider body in the opposite direction forces the zipper teeth elements through guide channels and into the joining channel, where the zipper teeth elements are interlocked again to close the slide fastener.

The bottom plate 108 of the slider body 104 typically has a flat lower surface and upwardly protruding bottom side rails 118. The top plate 109 may include downwardly protruding top side rails 119 along its lower surface. Top side rails 119 and bottom side rails 118 may be separated by a tape slot 123, through which the zipper tape passes during operation of the slide fastener. Top plate 109 and bottom plate 108 are usually joined by post 132, which divides the front end of the slider body 104. In conventional slider bodies, joining length 102 is greater than the length of post 132. Typically, the length of post 132 is less than one half the joining length 102, and is approximately one third, one fourth, or one fifth the length of joining length 102.

Slider cap 101 is mounted to the upper surface of top plate 109 of the slider body and holds the pull tab 103 in place. Slider cap 101 may include a locking pin mechanism that moves locking pin 105 when pull tab 103 is pulled in the direction of arc 120 when the slider body is moved along a length of zipper tape to close a slide fastener. Pull tab 103 bears against element 107, which forces pull tab 103 to bear against the underside of slider cap 101. This causes slider cap 101 to rotate around pivot point 106 along an arc essentially parallel to arc 120, thereby moving locking pin 105 out of the teeth of the zipper tape.

Figure 2:
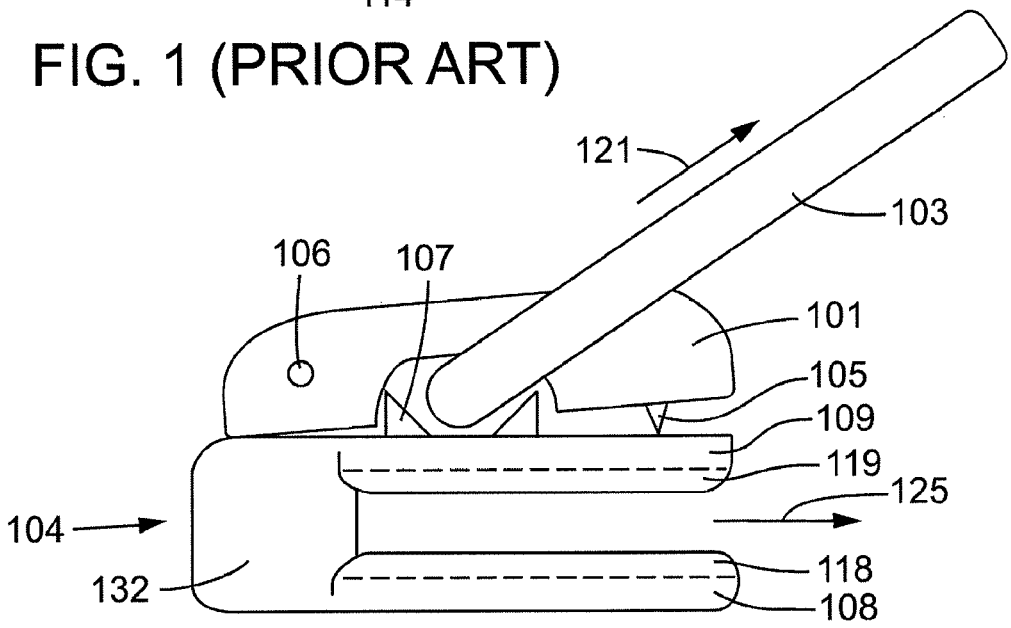
FIG. 2 (PRIOR ART)
FIG. 2 illustrates a side view of a conventional slider body showing the pull tab in an operating position and a locking pin in the unlocked position.

FIG. 2 illustrates the conventional slider body 104 of FIG. 1 with the slider cap 101 in a raised position, raising locking pin 105 away from the teeth of the zipper tape. Slider body 104 is moved along the zipper tape to open the slide fastener by pulling pull tab 103 in a direction 121. Slider cap 101 is connected to locking pin 105, allowing the locking pin 105 to be moved from between the zipper teeth of the zipper tape, thereby allowing the slider body to move in direction 125.

Figure 3A:
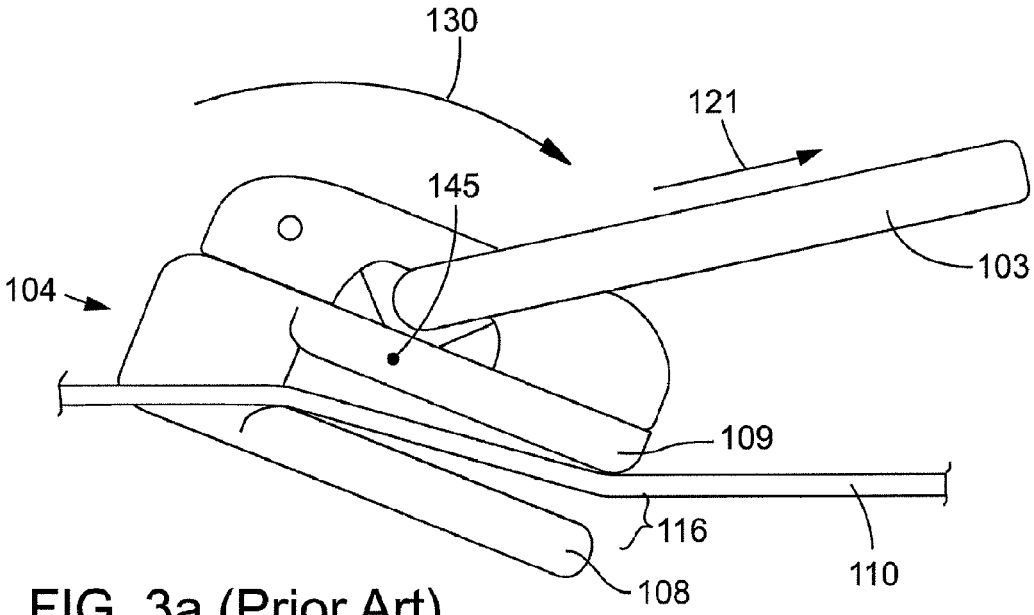
FIG. 3a (Prior Art)
FIG. 3*a* illustrates a side view of a conventional slider body being operated to open a slide fastener.
Figure 3B:
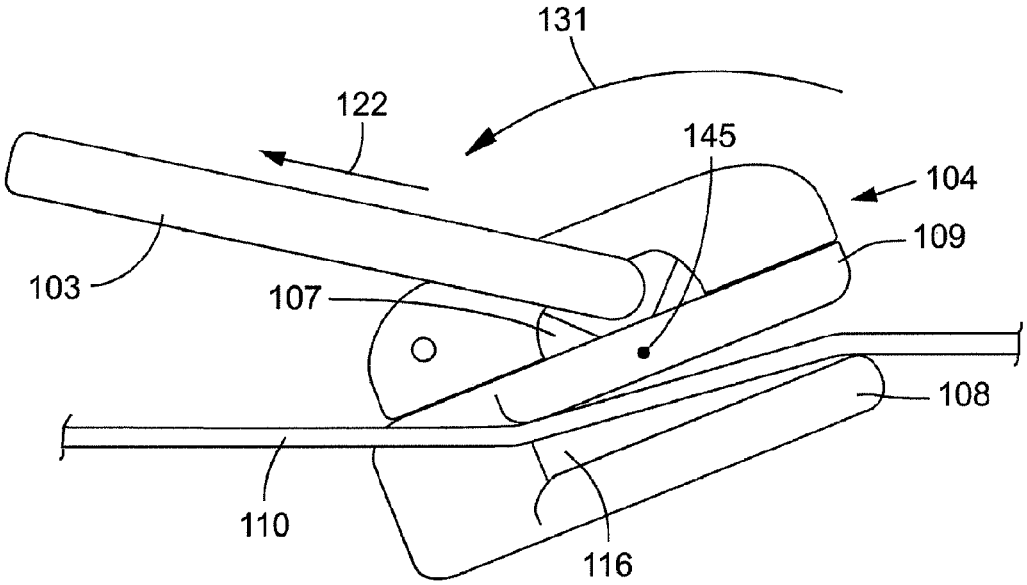
FIG. 3b (Prior Art)
FIG. 3*b* illustrates a side view of a conventional slider body being operated to open a slide fastener.

FIGS. 3*a* and 3*b* illustrate a side view of a conventional slider body being operated to open (FIG. 3*a*) and close (FIG. 3*b*) a slide fastener. In FIG. 3*a*, pull tab 103 is being pulled in direction 121, causing slider body 104 to move in substantially the same direction along the length of zipper tape 110. Movement of slider body 104 in direction 121 causes interlocked zipper teeth elements along the length of zipper tape 110 to become uncoupled, opening the slide fastener. Pulling the pull tab 103 in direction 121 also causes slider body 104 to rotate around the center of mass point 145 of the slider body 104 and in the direction of arc 130. The rotation tilts the front of the slider body 104 downward, pushing the zipper tape 110 against the bottom surface of top plate 109 and widening the gap 116 between zipper tape 110 and bottom plate 108.

In FIG. 3*b*, pull tab 103 is being pulled in direction 122, whereby slider body 104 moves in substantially the same direction along the length of zipper tape 110 causing zipper teeth elements along the length of zipper tape 110 to become interlocked. Pulling the pull tab 103 in direction 122 causes slider body 104 to rotate around the center of mass 145 of the slider body 104 and in the direction of arc 131. As described above, this rotation tilts the slider body 104 downward, pushing the zipper tape 110 against the bottom surface of top plate 109 and widening the gap 116 between zipper tape 110 and bottom plate 108. The rotation of the slider body as shown in FIGS. 3*a* and 3*b* and resulting widening of gap 116 allows the jamming of materials, such as an inner layer of fabric (e.g. a lining of a garment), within the slider body 104 as described below.

Figure 4A:
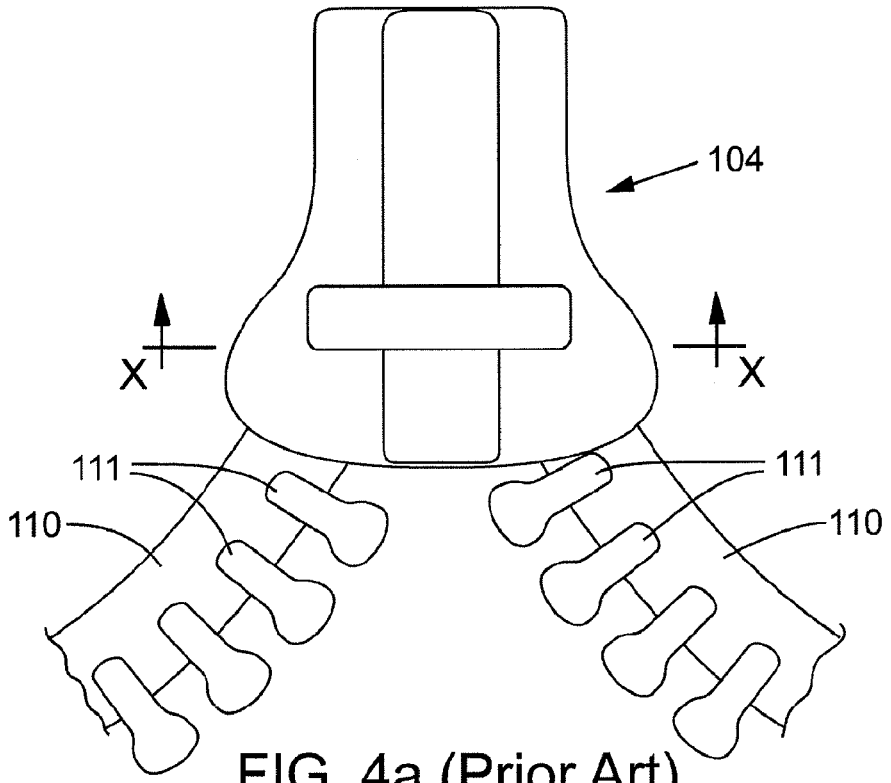
FIG. 4a (Prior Art)
FIG. 4*a* illustrates a top view of a conventional slider body with a portion of a zipper tape engaged with the slider body.

FIG. 4*a* illustrates a top view of a zipper tape 110, comprising zipper teeth elements 111, coupled to a conventional slider body 104. FIG. 4*b* illustrates a cutaway view of the slider body 104 of FIG. 4*a* along the plane X-X. As shown in FIG. 4*b*, top plate 109 includes top side rails 119, while bottom plate 108 includes bottom side rails 118. Zipper tape 110 is shown disposed between top plate 109 and bottom plate 108, with zipper teeth elements 111 disposed within the guide channels 115. An outer layer 140, such as the outer shell of a jacket, is coupled to zipper tape 110 by a coupling element 142 (e.g. thread or adhesive). An inner layer 141, such as an inner liner of a jacket, is also coupled to zipper tape 110 by coupling element 142. In a typical jacket or other outerwear application, outer layer 140 is made from a relatively thick fabric material such as leather, while inner layer 141 is made of a relatively thin fabric material such as silk or polyester. The dimensions of inner layer 141 are generally greater than those of outer layer 140 in order to ensure some amount of "give" and to prevent bunching of the outer layer. The larger relative size of inner layer 141 causes the additional material of that layer to fold or bunch in locations where it is coupled to outer layer 140, especially near trimmings such as zipper tape 110.

As shown in FIG. 4*b*, inner layer 141 is prone to becoming enmeshed with zipper teeth elements 111 if a portion of inner layer 141 is permitted to enter guide channel 115. A rotation of slider body 104 as pull tab 103 is pulled increases the size of gap 116, permitting entry of a portion of inner layer 141. The portion of inner layer 141 may jam the slider body 104 before it reaches the guide channel 115. Alternatively, if the portion of inner layer 141 is thin enough to pass into the guide channel 115 along with zipper tape 110, the portion of inner layer 141 may become enmeshed with zipper teeth elements 111 within the guide channel 115, causing a jam in the slider body 104 as shown at point 112 and/or causing permanent damage to inner layer 141 and/or the slider body 104.

Figure 4C:
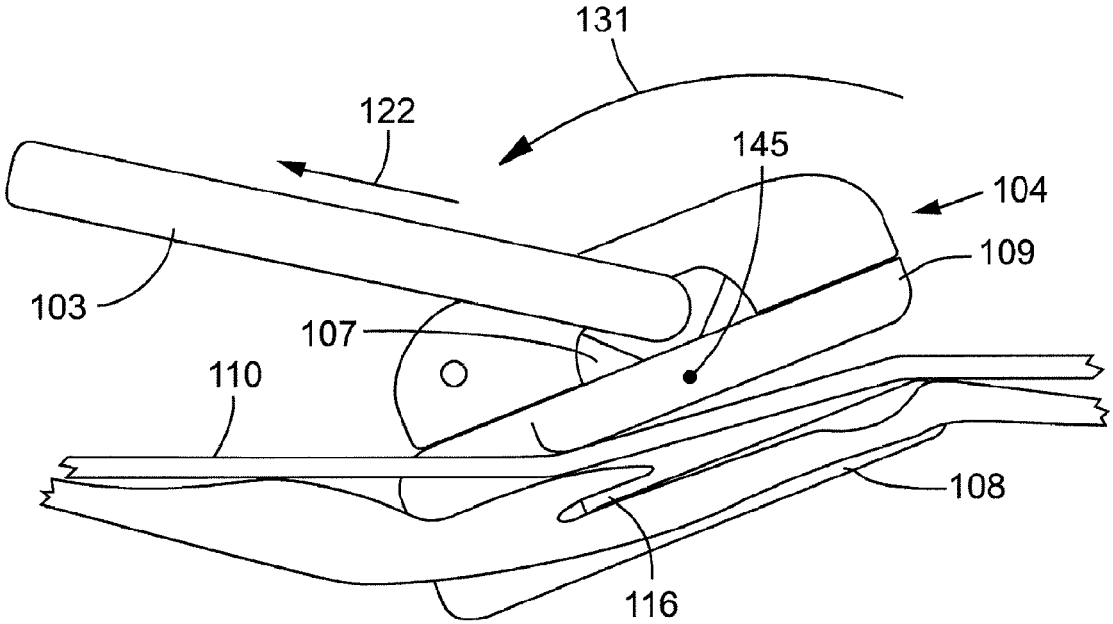
FIG. 4c (Prior Art)
FIG. 4*c* illustrates a side view of a conventional slider body with a portion of zipper tape engaged and an additional layer of material.
Figure 4B:
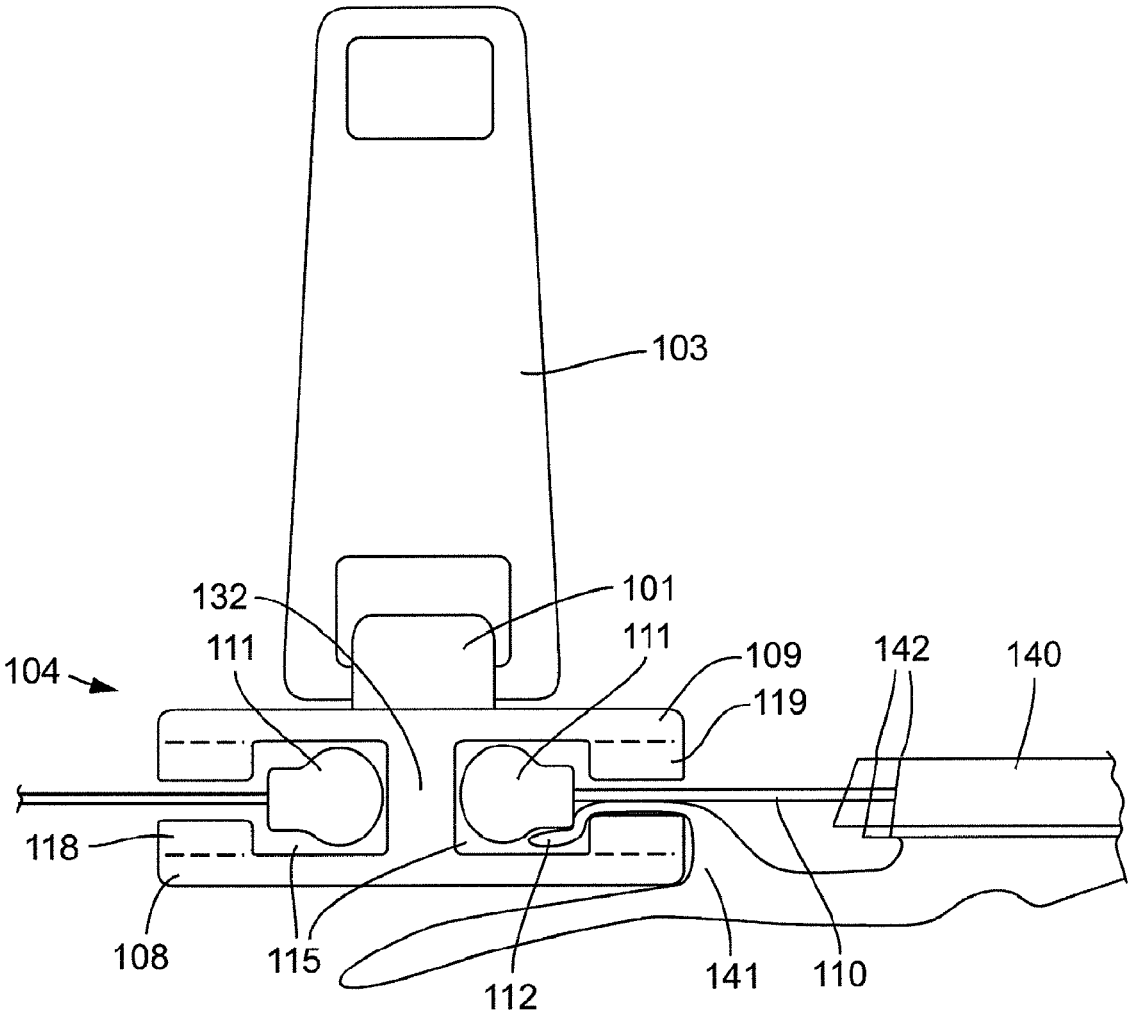
FIG. 4b (Prior Art)
FIG. 4*b* illustrates a cutaway view of a conventional slider body along section line X-X of FIG. 4*a;*

FIG. 4*c* illustrates a side view of the conventional slider body of FIGS. 3*a* and 3*b* with an inner layer 141 disposed in proximity to zipper tape 110. A portion of inner layer 141 is shown near the post 132 of slider body 104. As the pull tab 103 is rotated along arc 131 and pulled in direction 122 to close the slide fastener, guide channels 115 (defined by post 132, top plate 109, top side rails 119, bottom plate 108 and bottom side rails 118) receive the zipper teeth elements 111 mounted on zipper tape 110. The rotation of the slider body about its approximate center of mass point 145 increases the size of the gap 116 below the zipper tape 110 as zipper tape 110 enters the guide channels 115, creating an opportunity for a portion of inner layer 141 to enter the gap 116 and to be pulled with zipper tape 110 into guide channel 115. As the zipper tape 110 proceeds through guide channels 115 the gap between the zipper tape and the bottom side rail 118 decreases due to the angle of the slider body 104, causing the entrapped inner layer 141 to become jammed within the tape slot 123 and/or guide channel 115 of slider body 104. Therefore, the rotation of the slider body 104 increases the likelihood that inner layer 141 will become enmeshed with zipper tape 110 and/or between the zipper teeth elements 111 during opening or closing of the slide fastener.

Figure 5A:
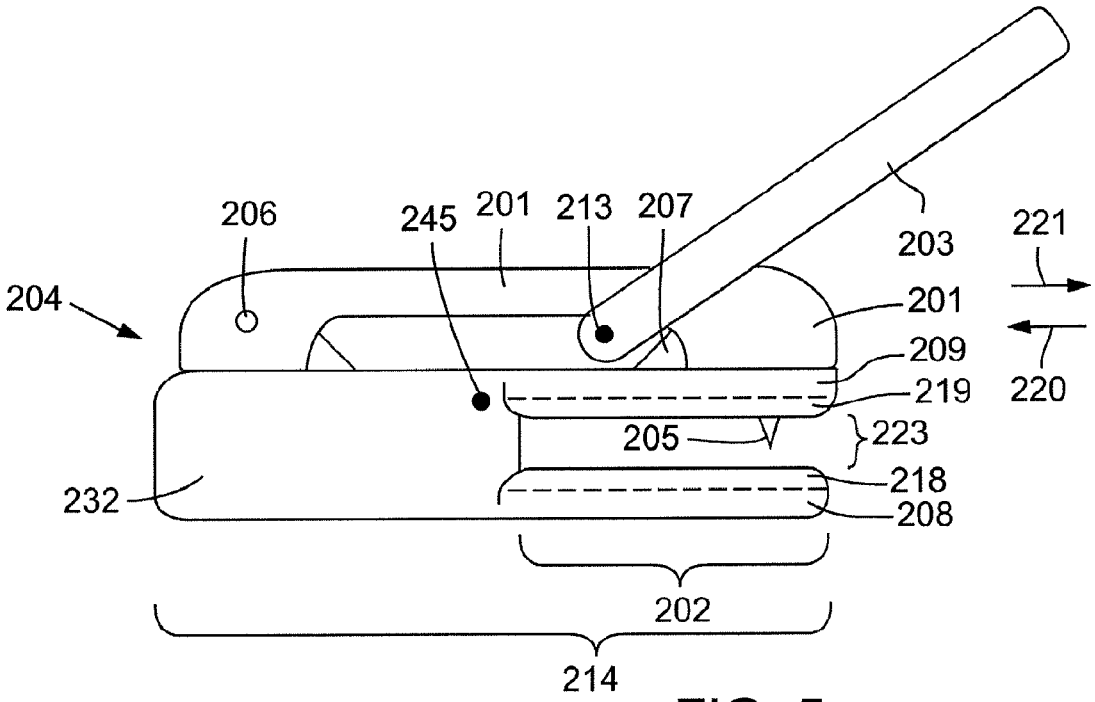
FIGS. 5*a-b* illustrate side views of a modified slider body in accordance with various embodiments.
Figure 5B:
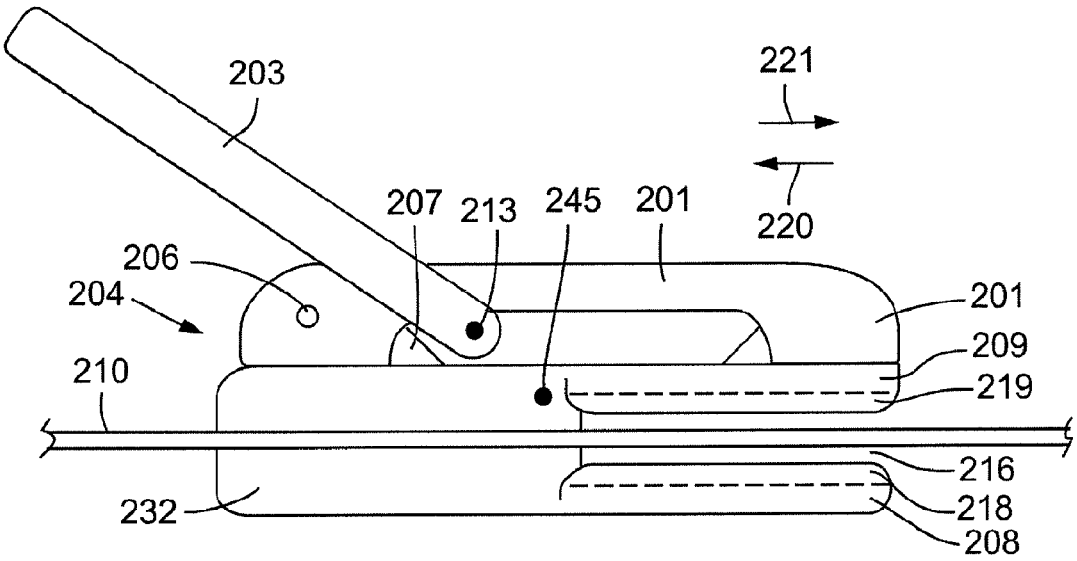

FIGS. 5*a* and 5*b* illustrate side views of an improved slider body in accordance with various embodiments. As shown in FIG. 5*a*, a slider body 204 may include a slider cap 201, a pull tab 203, a locking pin 205, a bottom plate 208, a top plate 209, and a post 232. Top plate 209 may include downwardly projecting top rails 219. Bottom plate 208 may include upwardly projecting bottom rails 218. Top plate 209 and bottom plate 208 may be coupled by plate coupler 232, which in some embodiments may be a post. Plate coupler 232 and top plate 209 and/or bottom plate 208 may be formed as a single unit. In other embodiments, plate coupler 232 and top plate 209 and/or bottom plate 208 may be formed as separate components and coupled. Bottom rails 218 and top rails 219 may be separated by a tape slot 223 (FIG. 5*a*).

Slider cap 201 may be coupled to top plate 209. In some embodiments, slider cap 201 may be coupled to a locking pin 205, which may be positioned within an opening passing through the thickness of top plate 209. Top plate 209 may be coupled along its upper surface to one or more elements 207.

In some embodiments, top plate 209 and element 207 may be formed as a single unit, while in other embodiments top plate 209 and element 207 may be formed as separate components that are subsequently coupled. Pull tab 203 may be coupled to slider cap 201 to pull the modified slider body 204 in direction 221 in order to open a slide fastener and in direction 220 in order to close the slide fastener.

In some embodiments, such as the embodiment illustrated in FIG. 5*a*, slider cap 201 and/or modified slider body 204 may be significantly longer than the corresponding elements of the slider of FIG. 1 (i.e. slider cap 101 and slider body 104). As illustrated, slider cap 201 may be significantly longer than joining length 202. In embodiments, plate coupler 232 may be longer than the corresponding post of the conventional slider body (i.e. post 132). For example, the length of slider cap 201 may be at least 1.5 times the length of joining length 202 (e.g. 150% of the length of the joining length). As another example, the length of slider cap 201 may be approximately twice the length of joining length 202 (e.g. 200% of the length of the joining length). As another example, the length of slider cap 201 may be greater or substantially equal to length 214, which is the total length of the plate coupler 232 and joining area 202.

In operation, pulling the pull tab 203 may rotate the pull tab 203 around pivot point 213, forcing pull tab 203 against element 207 and against the underside of slider cap 201. The force applied against slider cap 201 may cause slider cap 201 to rotate around pivot point 206, thereby moving locking pin 205 out of the teeth of a zipper tape. Some embodiments may lack a locking pin 205, pivot point 206, and/or element 207.

The upper surface of bottom plate 208 of modified slider body 204 may comprise a flat surface portion. The increased length of the slider cap 201 relative to the slider cap 101 of a conventional slider body may permit pull tab 203 to slide within the elongated area of open space between the upper surface of top plate 209 and the lower surface of slider cap 201 as the pull tab 203 is pulled to open a slide fastener (pulling in direction 221) or to close a slide fastener (pulling in direction 220). In either case, when the pull tab 203 is pulled, the sliding of pull tab 203 results in the positioning of pivot point 213 at a significant distance from the center of mass (near center of mass point 245) of modified slider body 204, thereby reducing rotation of the modified slider body 204 around the center of mass point 245. The reduction in rotation results in reducing the potential for snagging of the zipper.

In FIG. 5*b*, showing an embodiment of the modified slider body 204 of FIG. 5*a* with the locking pin 205 disengaged, the pull tab 203 is shown positioned to pull the slider body in direction 220 to close the slide fastener. The modified slider body 204 may be less prone to rotation during the operation as a result of the increased distance of the rotation center 213 of pull tab 203. Reduction of slider body rotation may reduce the increase in the size of the gap between the bottom side rails and the zipper tape that is observed during operation of conventional slider bodies. This may in turn help to prevent inner layer 241 from being pulled into tape slot 223 through the enlarged gap, thereby reducing or eliminating jamming of materials (e.g. an inner layer) within the modified slider body 204, between the zipper teeth elements of zipper tape 210 and/or within tape slot 223.

Figure 6:
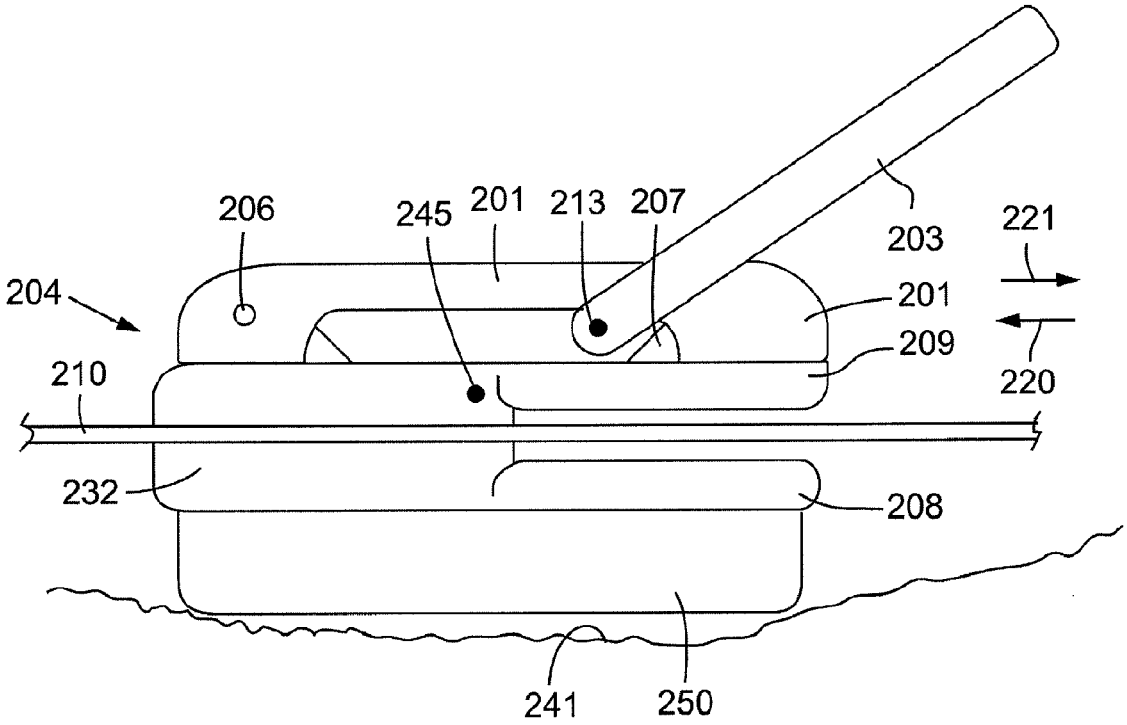
FIG. 6 illustrates a side view of a modified slider body comprising a protrusion on the bottom plate in accordance with various embodiments.

FIG. 6 illustrates another embodiment of a slider body of the present invention. In this embodiment, bottom plate 208 of modified slider body 204 may include a protrusion 250. Protrusion 250 may be shaped, sized, and/or otherwise configured to push inner layer 241 away from zipper tape 210 to further minimize potential jamming or snagging of inner layer 241 within modified slider body 204. In some embodiments, protrusion 250 may be formed/constructed with bottom plate 208 as a single unit. In other embodiments, protrusion 250 may be formed as a separate unit and may be subsequently coupled to bottom plate 208. In one embodiment, protrusion 250 may be manufactured as a separate unit suitable for coupling to a previously manufactured and/or previously installed slider body.

Figure 7:
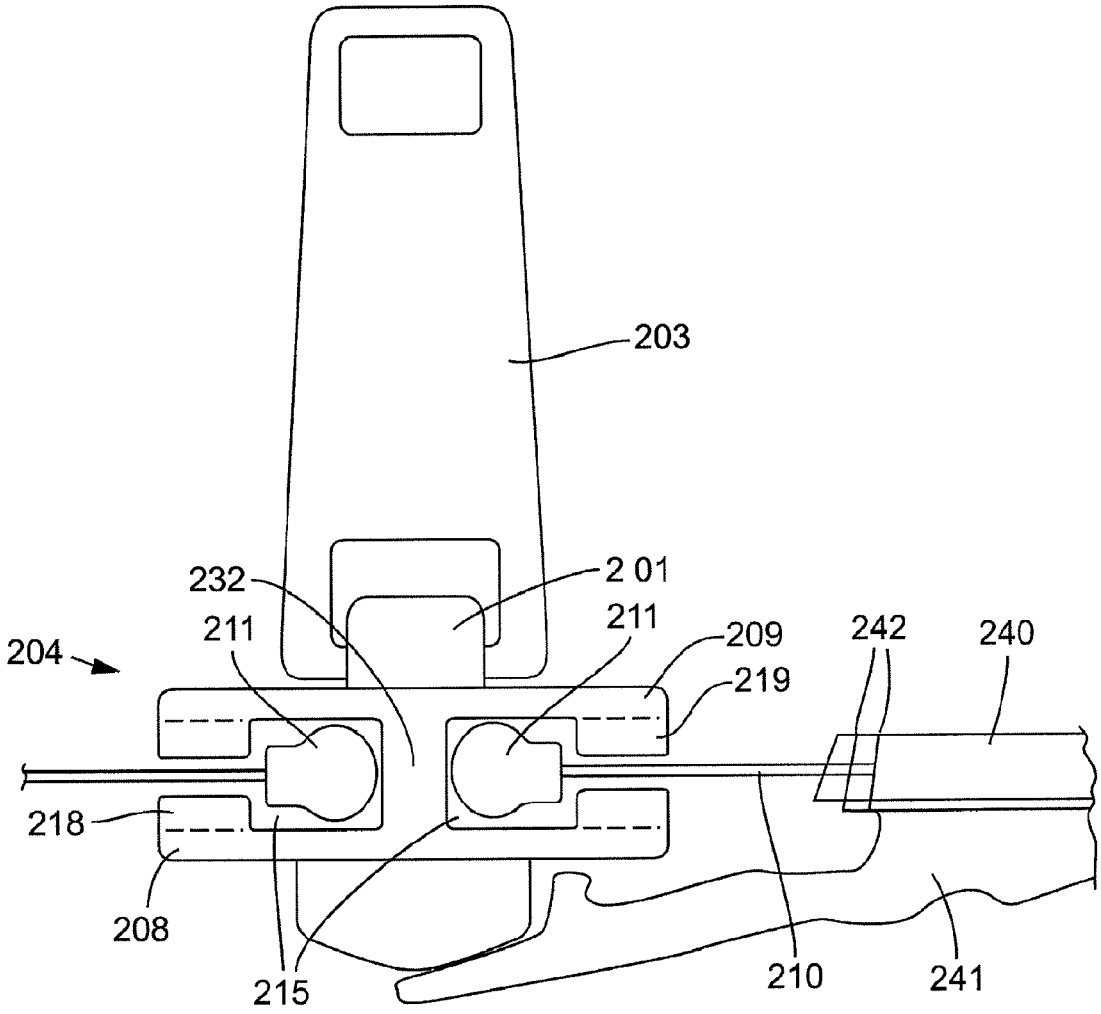
FIG. 7 illustrates a front view of a modified slider body with a plow-shaped protrusion on the bottom plate and a loose fabric liner in accordance with various embodiments.

FIG. 7 illustrates a cutaway view of a modified slider body 204 coupled to a zipper tape 210, which includes zipper teeth elements 211. As shown, zipper tape 210 passes through tape slots 223 as zipper teeth elements 211 are received by guide channels 215. An outer layer 240, such as the outer shell of a jacket, may be coupled to zipper tape 210. An inner layer 241, such as an inner liner of a jacket, may also be coupled to fabric layer 240 and/or to zipper tape 210. Zipper tape 210 may be coupled to fabric layers 240 and 241 by coupling element 242 and/or by any suitable means. Coupling element 242 may be any element known in the art for coupling materials such as fabrics (e.g. a seam, an adhesive, a mechanical fastener, etc.).

Protrusion 250 may push loose portions of inner layer 241 further away from zipper tape 210 and guide channels 215 than a slider body without a protrusion 250, further reducing jamming or snagging of inner layer 241 within the modified slider body 204. Embodiments may vary as to the size and/or shape of protrusion 250. In some embodiments, protrusion 250 may be wider and/or thicker than bottom plate 208. In other embodiments, protrusion 250 may be curved, plow-shaped, pointed, V-shaped, U-shaped, and/or wider/thicker at one end. Protrusion 250 may extend above bottom plate 218. In some embodiments, protrusion 250 may also extend laterally from bottom plate 218.

Figure 8A:
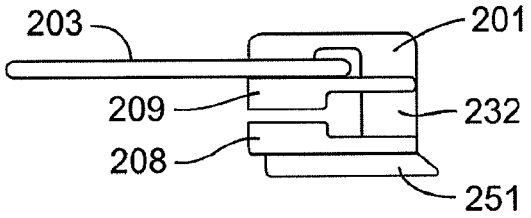
FIGS. 8*a*-8*j* illustrate side views of modified slider bodies with bottom plate and/or plate coupler protrusions in accordance with various embodiments.
Figure 8B:
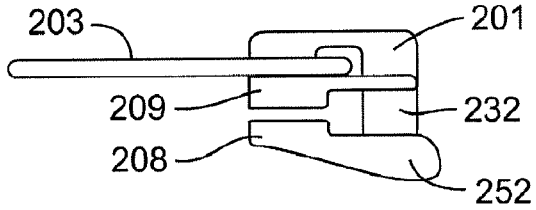
Figure 8C:
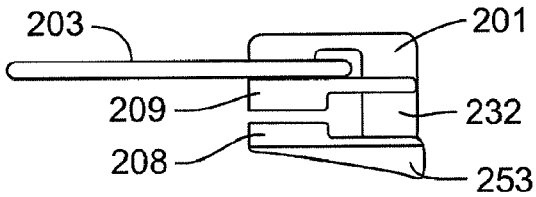
Figure 8D:
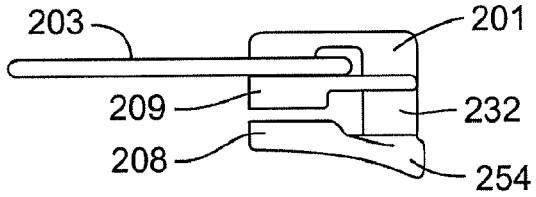
Figure 8E:
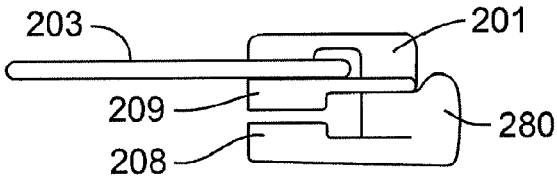
Figure 8F:
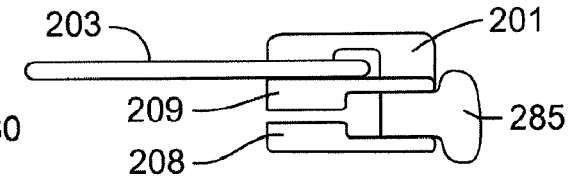
Figure 8G:
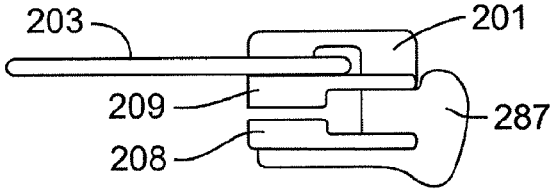
Figure 8H:
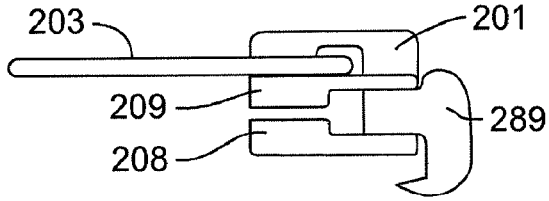
Figure 8I:
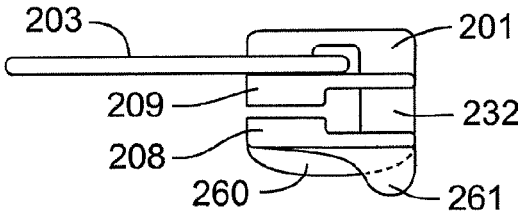

FIGS. 8*a*-8*j* illustrate side views of modified slider bodies with bottom plate and/or plate coupler protrusions in accordance with various embodiments. FIG. 8*a* shows an embodiment of a modified slider body with a flat, plow-shaped protrusion 251 coupled to the bottom plate 208. FIG. 8*b* shows an embodiment of a modified slider body with a curved, plow-shaped protrusion 252 coupled to the bottom plate 208. FIG. 8*c* shows another embodiment of a modified slider body with a thinner curved, plow-shaped protrusion 253 coupled to the bottom plate 208. FIG. 8*d* shows an embodiment of a modified slider body with a curved, plow-shaped protrusion 254 formed as part of a bottom plate 208. FIG. 8*e* shows an embodiment of a modified slider body with a prow-shaped protrusion 280. In some embodiments, protrusion 280 may be formed as part of bottom plate 208 and/or a central plate coupler (e.g. plate coupler 232). In other embodiments, protrusion 280 may include a vertical aperture through which a central plate coupler is threaded, coupling the top plate 209 to the protrusion 280/bottom plate 208. FIG. 8*f* shows an embodiment of a modified slider body with a prow-shaped protrusion 285 extending from the central plate coupler. Again, protrusion 285 and the central plate coupler may be formed as a single component or as separate components. FIG. 8*g* shows an embodiment of a modified slider body with a prow-shaped protrusion 287 extending from the central post and coupled to the bottom plate 208. FIG. 8*h* shows an embodiment of a modified slider body with a prow-shaped protrusion 289 extending from the central plate coupler and under the bottom plate 208 ending in a scoop or plow shape. FIG. 8*i* shows an embodiment of a modified slider body with a curved downward-projecting protrusion 260 that includes side portions 261. Side portions 261 may project laterally and/or downward from the bottom of bottom plate 208.

Figure 8J:
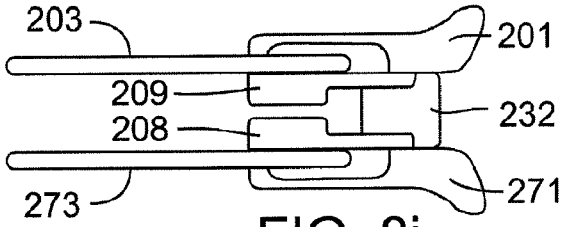

FIG. 8*j* shows an embodiment of a modified slider body with a first slider cap 201 coupled to top plate 209 and a second slider cap 271 coupled to bottom plate 208. A post 232 may join top plate 209 to bottom plate 208. In some embodiments, post 232 may join one or more slider caps, such as first slider cap 201 and second slider cap 271, to another component of the slider body (e.g. to top plate 209 and/or to bottom plate 208). First slider cap 201 and/or second slider cap 271 may be elongated to minimize rotation of the slider body. In some embodiments, first slider cap 201 and/or second slider cap 271 may include a plow-shaped and/or prow-shaped protrusion extending outwardly to the front, rear, top, bottom, and/or side of the slider body. Such slider caps/protrusions may be shaped to push fabric or other materials away from the zipper tape during operation of the slider body. In various embodiments, a slider cap may include a protrusion shaped essentially as shown in any of FIGS. 8*a*-8*i* (i.e. protrusions shown projecting from a top/bottom plate or post may instead project from a slider cap). As shown in FIG. 8*j*, some embodiments may comprise a post with a forward-projecting protrusion (e.g. post 232) and two slider caps with upward/downward/laterally-projecting protrusions to push materials away from the zipper tape, minimizing snagging or jamming of materials within the slider body. For example, first slider cap 201 may project forwardly and upwardly while second slider cap 271 may project forwardly and downwardly, and post 232 may project forwardly between the slider caps. In this example, first slider cap 201 may push materials upwardly away from the zipper tape, second slider cap 271 may push materials downwardly away from the zipper tape, and post 232 may push materials laterally away from the zipper tape during operation of the modified slider body.

Figure 9A:
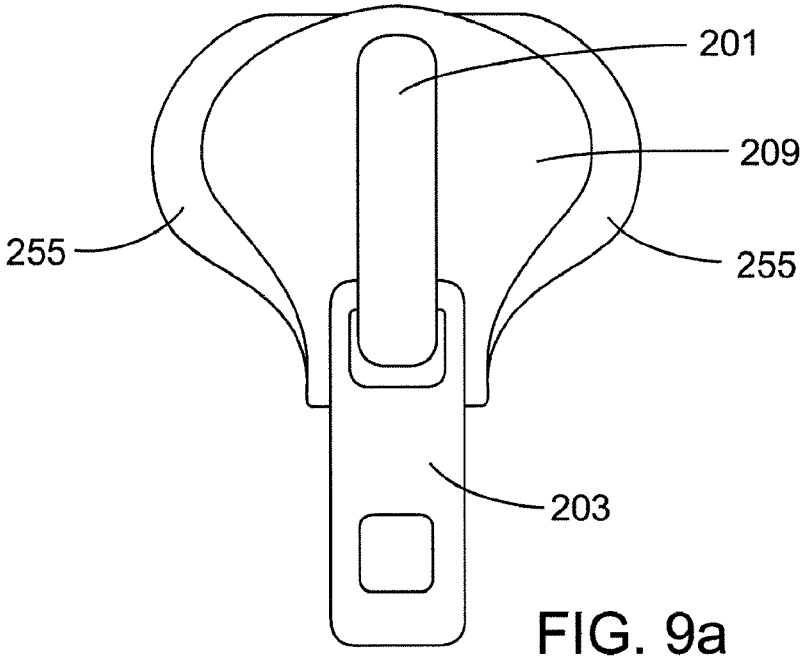
FIGS. 9*a* and 9*b* illustrate a modified slider body with a bottom plate protrusion in accordance with various embodiments.
Figure 9B:
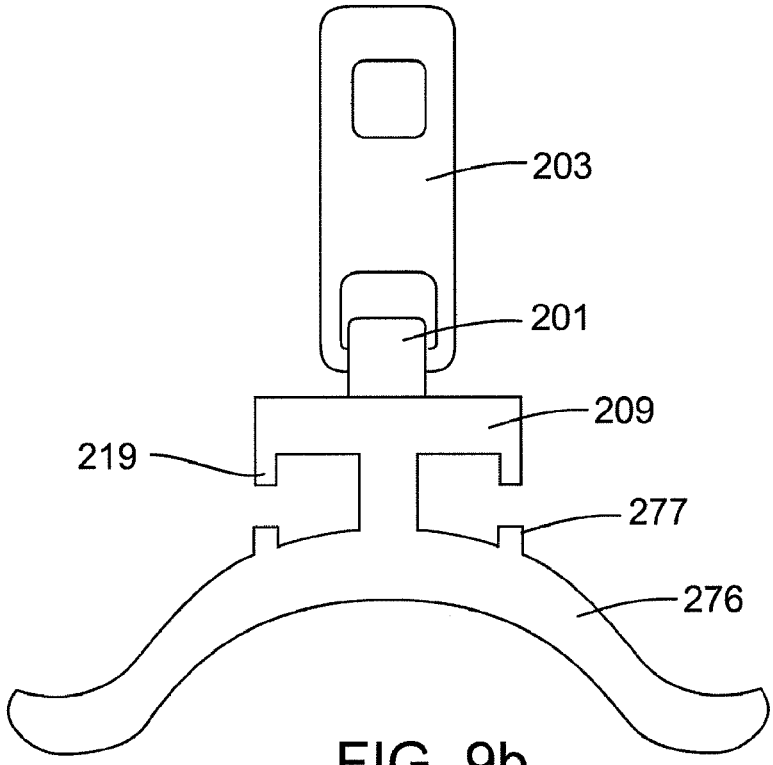

FIGS. 9*a* and 9*b* illustrates a modified slider body with a bottom plate protrusion in accordance with various embodiments. FIG. 9*a* shows a top view of the modified slider body, while FIG. 9*b* shows a cutaway view of the same modified slider body. As shown in FIG. 9*b*, a modified bottom plate 276 may include bottom side rails 277. The modified bottom plate 276 may further include downward- and laterally-projecting side portions 255 (see FIG. 9*a*). Side portions 255 may push one or more layers of fabric, such as the lining of a garment, away from the zipper tape during operation of a slide fastener.

Figure 10A:
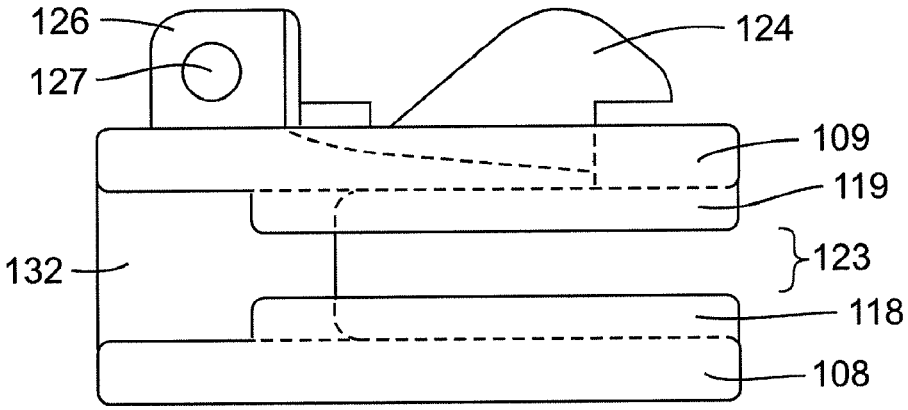
FIG. 10a (Prior Art)
FIG. 10*a* illustrates a conventional slider body with horizontally and vertically parallel top and bottom side rails.

FIG. 10*a* shows a conventional slider body with horizontally and vertically parallel top and bottom side rails. The conventional slider body illustrated in FIG. 10*a* includes a top plate 109 with top side rails 119, a bottom plate 108 with bottom side rails 118, a post 132 connecting top plate 109 and bottom plate 108, a coupler 126 coupled to an upper surface of top plate 109, and an element 124 coupled to coupler 126. Element 124 is further coupled to top plate 109. Coupler 126 further includes a pivot 127.

In FIG. 10*a*, the tape slot 123 is approximately 0.040 inches in height, as measured from the upper surface of bottom side rails 118 to the bottom surface of top side rails 119. Because the top and bottom side rails 118/119 are both horizontally and vertically parallel, the tape slot 123, top side rails 119, and bottom side rails 118 are all equal in length, and the tape slot 123 is approximately 0.040 inches in height along its entire length. Post 132 does not extend beyond the edges of top side plate 109 and bottom side plate 108. The long and narrow tape slot allows materials to become snagged or jammed within the tape slot, and the non-protruding post does not function to push fabric or other materials away from the zipper tape during operation of the conventional slider body. Thus, the conventional configuration urges snagging and jamming of materials (such as an inner lining of a garment) in the slider body.

Figure 10B:
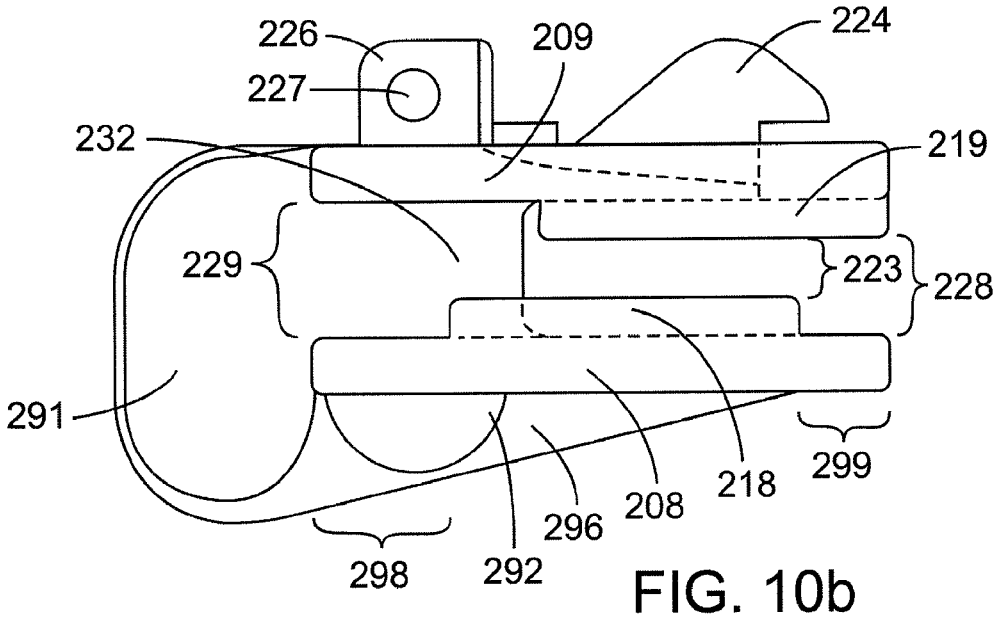
FIGS. 10*b*-10*d* illustrate a modified slider body with a protruding plate coupler and offset top and bottom side rails in accordance with various embodiments.
Figure 10C:
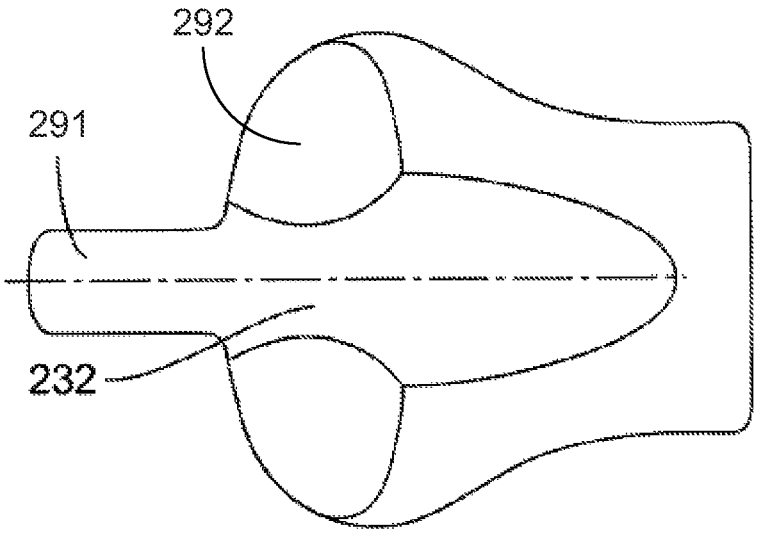
Figure 10D:
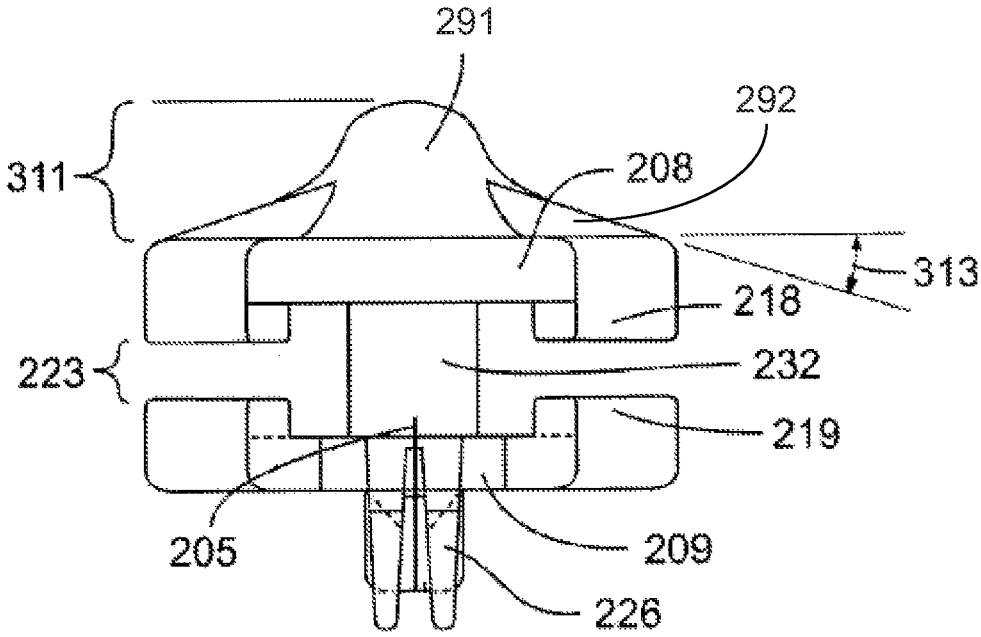

In contrast, FIGS. 10*b* to 10*d* illustrate a modified slider body with a protruding plate coupler and offset top and bottom side rails in accordance with various embodiments. The modified slider body shown in FIG. 10*b* includes a top plate 209 with top side rails 219, a bottom plate 208 with bottom side rails 218, a plate coupler 232 connecting top plate 209 and bottom plate 208, a coupler 226 coupled to an upper surface of top plate 209, and an element 224 coupled to coupler 226. Element 224 is further coupled to top plate 209. Coupler 226 further includes a pivot 227.

As shown in FIG. 10*b*, a modified slider body may include a plate coupler 232 with a first protrusion 291 and second protrusion 292. First and second protrusions 291/292 may be arranged serially, with the first protrusion 291 protruding both forward and downward (shown). In other embodiments, first and second protrusions 291/292 may be laterally parallel (i.e. disposed side-by-side). Some embodiments may lack a second protrusion 292. First and second protrusions 291/292 may be plow- or prow-shaped and may function to push fabric/materials away from a zipper tape during operation of a slide fastener.

Embodiments may include one or two side walls 296 extending vertically along one or both sides of the modified slider body and covering at least some portion of plate coupler 232, first protrusion 291, second protrusion 292, and/or top side rail 209. Other embodiments may lack a side wall 296. In some embodiments, side walls 296 may be shaped to push materials away from a zipper tape during operation of a slide fastener.

A modified slider body may include a tape slot 223 with a vertical height measured as the distance between the lower surface of a top side rail 219 and the upper surface of the opposing bottom side rail 218. As shown in FIG. 10*b*, the tape slot 223 of a modified slider body may be shortened relative to the total length of the slider body, due to the offsetting of the top side rail 219 and bottom side rail 218. In some embodiments, the length of tape slot 223 may be no more than half the length of the modified slider body. In other embodiments, the length of tape slot 223 may be no longer than the length of plate coupler 232. In one embodiment, the length of tape slot 223 may be no longer than one-third the length of the modified slider body.

Top side rail 219 may extend to the rear terminus of top plate 209 (i.e. end opposite plate coupler 232). Bottom side rail 218 may be set at a length 298 from the front of bottom plate 208 and may terminate before reaching the rear terminus of bottom plate 208, leaving a length 299 of bottom plate 208 at the rear terminus and a length 298 of bottom plate 208 without a bottom side rail 219. In one embodiment, the top side rail 219 may be approximately the same length as bottom side rail 219 and may be offset toward the rear terminus of top plate 209 in comparison to bottom side rail 218. For example, top side rail 219 may begin at a distance from the front of top plate 219 equal to the sum of length 298 and length 299, extending to the end terminus of top side plate 219 (i.e. the end opposite plate coupler 232).

The tape slot 223 may be flanked at one end by a first flanking region with a bottom side rail 218 and no top side rail 219, and may be flanked at the other end by a second flanking region with a top side rail 219 and no bottom side rail 218. In embodiments with top and bottom side rails of equal heights, the first and second regions may be of equal heights. As shown in FIG. 10*b*, height 229 is the distance between the portions of bottom plate 218 and top plate 219 that lack top/bottom side rails. Height 228 is the vertical height of the first and second flanking regions (i.e. the distance between the portion of the bottom surface of top plate 219 that lacks a rail and the upper surface of bottom rail 218; also the distance between the portion of the upper surface of bottom plate 208 that lacks a rail and the lower surface of top rail 219).

Embodiments may vary in the height of tape slot 223, length 299/298, height 228/229, and the length/height of the top and bottom side rails 219/218. For example, in one embodiment of a size 5 modified slider body (e.g. a modified slider body configured for use with the zipper tape of a standard size 5 zipper), tape slot 223 may have a height of about 0.055 inches, length 299 and length 298 may be about 0.080 inches, height 228 may be about 0.073 inches, top side rail 219 and bottom side rail 218 may have heights of about 0.018 inches, and height 229 may be about 0.091 inches. In other embodiments of a size 5 modified slider body, tape slot 223 may have a height within a range of about 0.050-0.060 inches, length 299 and length 298 may be within a range of about 0.070-0.090 inches, height 228 may be within a range of about 0.065-0.085 inches, top side rail 219 and bottom side rail 218 may have heights within a range of about 0.014-0.022 inches, and height 229 may be within a range of about 0.075-0.105 inches.

In other embodiments of a modified slider body, tape slot 223 may have a height within the range of about 0.030 to 0.090 inches, length 299/298 may be within the range of about 0.040 to 0.150 inches, height 228 may be within the range of about 0.035 to 0.150 inches, and height 229 may be within the range of about 0.040 to 0.180 inches. Top and/or bottom side rails 219/218 may have a length within the range of about 0.150 inches to 0.500 inches. Top and/or bottom side rails 219/218 may have a height within the range of about 0.005 to about 0.060 inches. In some embodiments, top side rails 219 and bottom side rails 218 may be of different lengths and/or different heights.

Other dimensions of a modified slider body may vary among embodiments. For example, in one embodiment, top and bottom plates 209/208 may be about 0.020 inches thick from their upper to lower surfaces, top side rail 219 and/or bottom side rail 218 may be about 0.005 inches thick from side to side, side walls 296 may have a height of about 0.365 inches, sloping downward and forward from a rear portion of the bottom plate 208 at an angle of approximately 13.46 degrees, and the width of the front of the modified slider body (i.e. front of plate coupler 232 and side walls 296) may be about 0.125 inches.

In some embodiments, modified slider bodies of different sizes (e.g. size 3, size 5, size 8, size 10, etc.) may have one or more relative proportions that are the same or similar. For example, a ratio of the height of tape slot 223 to height 228 may be substantially the same among a size 3, a size 5, a size 8, and/or a size 10 modified slider body. As another example, a ratio of the length of a top/bottom side rail to the length of a modified slider body may be substantially similar among a range of modified slider body sizes. In some embodiments, a ratio of flanking region length to side rail length may be approximately the same among modified slider bodies of different slider body sizes. In other embodiments, one or more of the size 5 modified slider body dimensions described above may be scaled up accordingly for larger sizes and/or scaled down accordingly for smaller sizes.

FIG. 10*c* illustrates a bottom view of the modified slider body of FIG. 10*b*. As shown, the slider body may include forward-projecting protrusion 291 and second protrusions 292. These protrusions may function to move fabric or other materials away from a zipper tape during operation of a slide fastener, reducing or preventing jamming of materials within the slider body.

FIG. 10*d* illustrates a rear view of a modified slider body. In FIG. 10*d*, the modified slider body is inverted (i.e. upside down) and shown from the rear terminus (non-post end) of the slider body. Protrusion 291, which has a height 311, may protrude downward and outward from the plate coupler 232. Protrusion 291, may function to move fabric or other materials away from a zipper tape during operation of a slide fastener, reducing or preventing jamming of materials within the slider body. The lower surface of bottom plate 208 may project downward from the rear terminus to the front end at an angle 313. The illustrated modified slider body may further include a tape slot 223, a coupler 226, locking pin 205, a top plate 209, top side rails 219, and bottom side rails 218. The dimensions of tape slot 223, height 311, and angle 313 may vary among embodiments. For example, tape slot 223 may have a height between approximately 0.030-0.090 inches, and in some embodiments between approximately 0.050 to 0.060 inches; height 311 may be between approximately 0.100-0.400 inches, and in some embodiments between approximately 0.120-0.130 inches; and angle 313 may be between about 8 and 30 degrees, and in some embodiments between approximately 17-19 degrees (e.g. about 18 degrees). Ranges provided herein are merely examples and are not intended to be limiting.

Figure 11A:
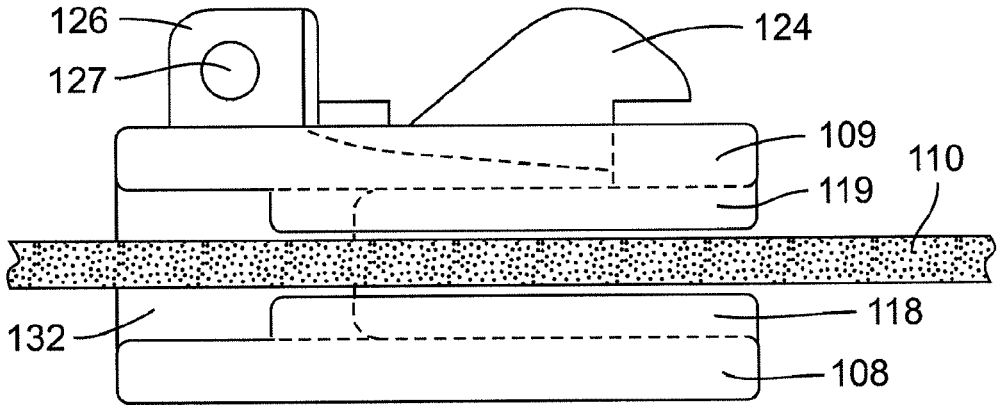
FIG. 11a (Prior Art)
FIG. 11*a* illustrates the conventional slider body of FIG. 10*a* coupled to a zipper tape.

FIG. 11*a* illustrates the conventional slider body of FIG. 10*a* coupled to a zipper tape. As previously discussed, the conventional slider body includes a relatively long, narrow tape slot that tends to urge jamming and snagging of materials in the slider body.

Figure 11B:
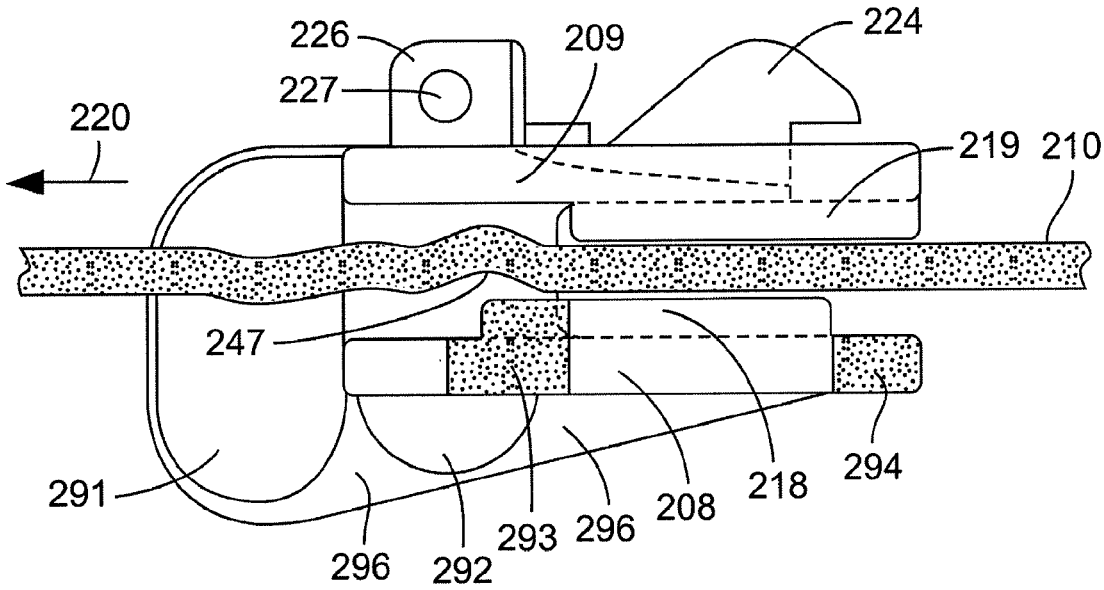
FIGS. 11*b-c* illustrate the modified slider body of FIG. 10*b* coupled to a zipper tape in accordance with various embodiments.

In contrast, FIG. 11*b* illustrates the modified slider body of FIG. 10*b* coupled to a zipper tape in accordance with various embodiments. The offset top and bottom side rails 219/218 may provide a relatively shorter tape slot flanked by wider regions, allowing a zipper tape 210 to shift vertically (e.g. at point 247, as shown) if additional fabric/material (e.g. a lining of a garment) is being pulled into the slider body. Because the zipper tape 210 can shift to accommodate the additional material, portions of the top/bottom side rails 219/218 and/or the top/bottom plates 209/208 (e.g. shaded portions 293 and 294) may push the additional fabric/material away before the additional fabric/material enters the tape slot. This may help to prevent the additional fabric/material from entering the tape slot and jamming the modified slider body.

Figure 11C:
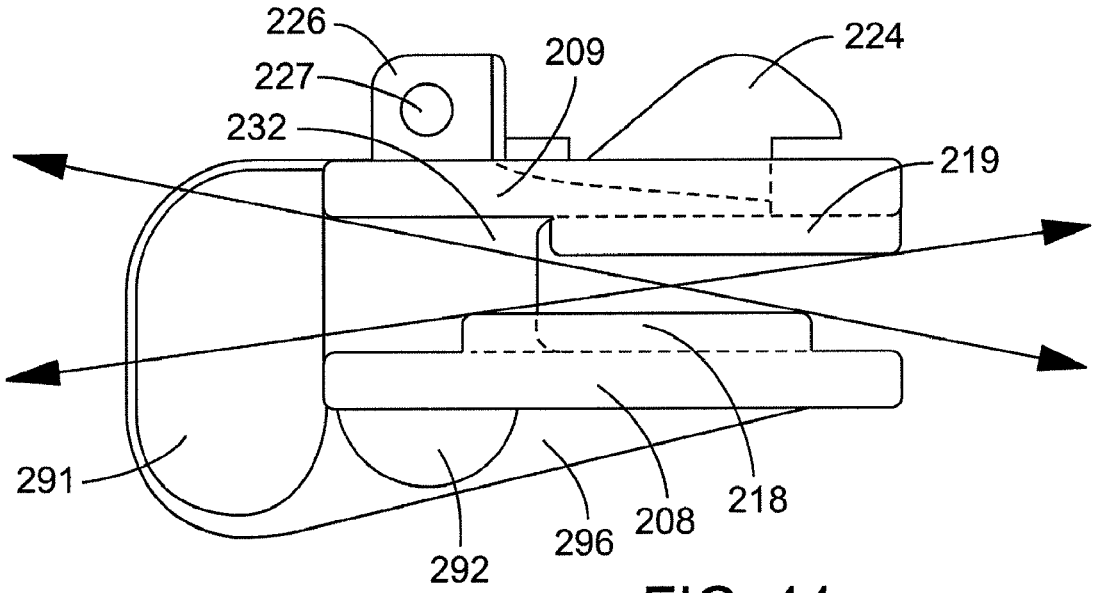

As illustrated in FIG. 11*c*, the relative configurations of the tape slot, flanking regions, and offset top/bottom side rails of a modified slider body may be sufficient to reduce or prevent snagging or jamming of additional fabric/material even where the modified slider body is rotated, causing the zipper tape to travel through the slider body at an angle (trajectory of zipper tape through rotated slider body shown by arrows). In some embodiments, the above features may prevent jamming of extraneous fabric/material in the modified slider body, even where the extraneous fabric/material is intentionally introduced into the tape slot. In some embodiments, the offsetting of the top and bottom side rails may be sufficient to accommodate rotation of the modified slider body, reducing or preventing jamming/snagging even with some rotation. Embodiments may include forward- and/or downward-projecting protrusions configured to move fabric/materials away from a zipper tape, further preventing or reducing jamming/snagging. In embodiments with a forward-projecting protrusion, the protrusion may function as a pre-plow, shifting excess fabric in advance of the front end of the modified slider body during operation of the slide fastener.

Figure 12:
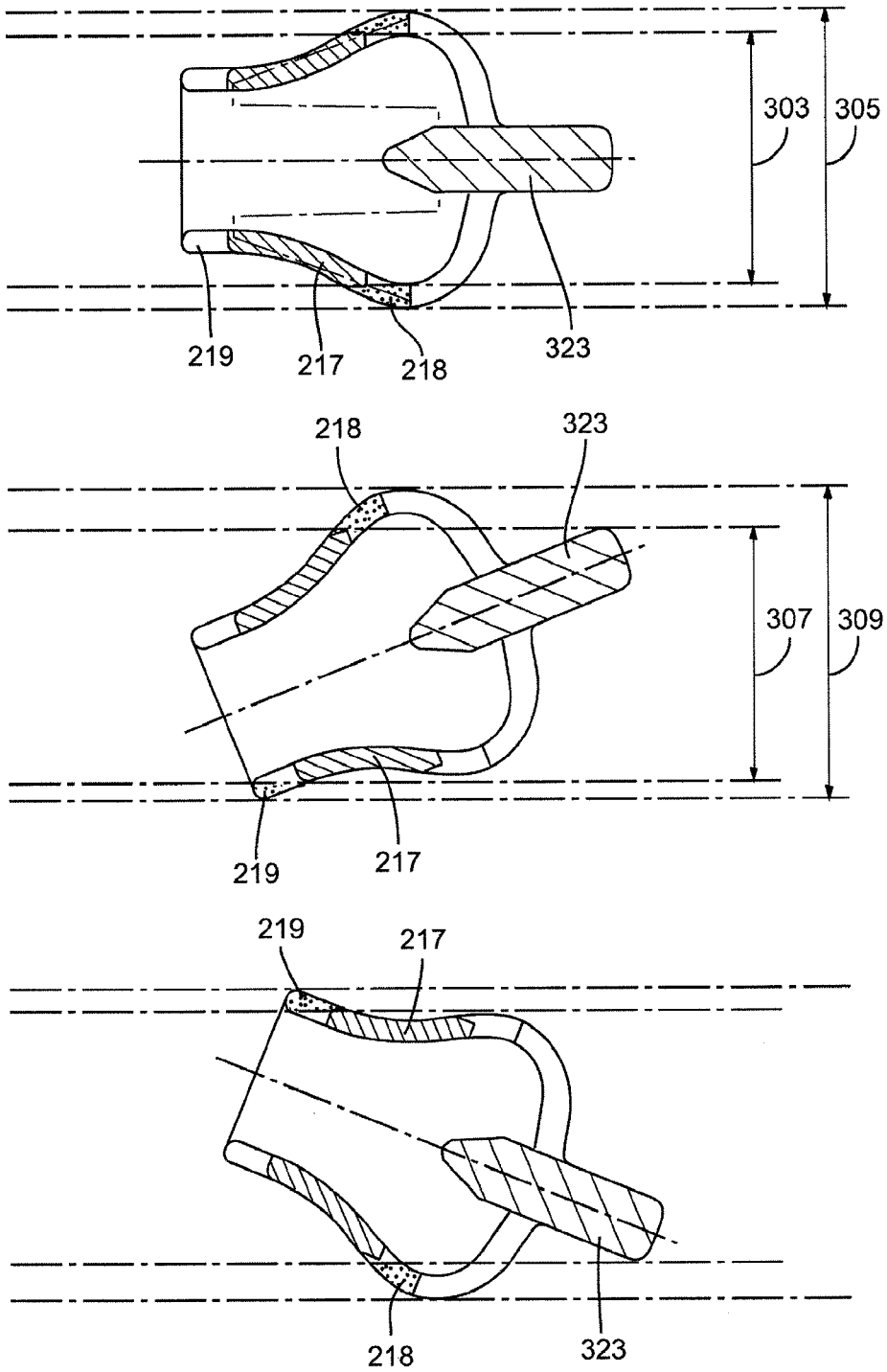
FIG. 12 illustrates top views of a modified slider body rotated along a horizontal plane during operation in accordance with various embodiments.

FIG. 12 shows top views of a modified slider body rotated along a horizontal plane during operation in accordance with various embodiments. Regions 217 show overlap of top side rails 219 and bottom side rails 218 (i.e. the tape slot). Portions of top side rails 219 and bottom side rails 218 that function to push fabric/materials away from the tape slot are shown as shaded areas. As illustrated at the top of FIG. 12, during operation of a modified slider body the bottom side rails may push fabric/materials, such as a lining layer, away from the tape slot. As the modified slider body is twisted along a horizontal plane to the left (FIG. 12, center) or to the right (FIG. 12, bottom), top side rails 219 may also function to push fabric/materials away from the tape slot. As a result, while conventional slider bodies are prone to jamming/snagging when twisted horizontally during operation, the modified slider bodies described herein may be twisted horizontally during operation without increased risk of snagging or jamming. In some embodiments, horizontal twisting/rotation of a modified slider body may result in improved anti-jamming/snagging function due to the participation of both a bottom side rail 218 and a top side rail 219 in pushing additional fabric away from the tape slot.

As discussed above, embodiments of a modified slider body may vary in dimensions. In the example shown in FIG. 12, a modified slider body may have a width 305, measured from side to side at the widest point of the modified slider body along planes parallel to the direction of slider body operation along a zipper tape. The modified slider body may also have a second width 303, measured in parallel to width 305 and approximately equal to the width of the modified slider body between the anterior ends of the tape slots on both sides. As shown in FIG. 12, horizontal rotation of the slider body during operation increases the exposure of the flanking regions along the direction of operation, positioning the flanking regions and/or side rails for improved plowing/pushing of fabric/materials away from the tape slot.

For example, in an embodiment of a size 5 slider body with a width 305 of approximately 0.508 inches and a second width 303 of approximately 0.429 inches, and bottom side rails 218 offset anterior to top side rails 219 by approximately 0.080 inches, approximately 15.6% of the width of the slider body (i.e. across the anterior portions of bottom side rails 208 preceding the tape slot) is positioned to push materials away from the tape slot. In other examples, approximately 10%-20% of the width of the modified slider body may be positioned to push materials away from the tape slot before horizontal twisting of the modified slider body. In comparison, as the modified slider body is twisted, the horizontal rotation of the modified slider body increases the exposure of the flanking portions of the tape slot to extraneous fabric/material (see e.g. FIG. 12, center, exposed portions shaded). For example, corresponding width 309 (measured in the same manner as for width 305) and corresponding second width 307 (measured in the same manner as for width 303) may become approximately 0.529 inches and approximately 0.427 inches, respectively, and approximately 19.3% of the width of the modified slider body 309 (including portions of both a bottom side rail 218 and a top side rail 219 flanking the tape slot) may be exposed and positioned to push away extraneous fabric/material. In other examples, approximately 15%-25% of the width of the modified slider body may be positioned to push materials away from the tape slot. In some embodiments, horizontal rotation of the modified slider body may increase the percentage of the width of the modified slider body exposed to about 3%-10%.

As described above, these dimensions are examples and are not intended to be limiting. Modified slider bodies of different sizes may have substantially similar proportions, and/or dimensions may be scaled up or down accordingly in larger or smaller modified slider body sizes. Therefore, in some embodiments, the offsetting of top and bottom side rails 218/219 may result in improved performance of a modified slider body and decreased jamming/snagging during horizontal twisting/rotation, due in part to the participation of both a bottom side rail 218 and a top side rail 219 in pushing fabric/materials away from the tape slot.

Embodiments described herein may include one, two, three, four or more anti-jamming/anti-snagging features such as a modified slider cap, an altered center of mass (e.g. due to a shorter tape slot 223 and/or modification of plate coupler 232), a forward-, upward-, laterally- and/or downward-projecting protrusion, increased height and/or decreased length of tape slot 232 and/or flanking regions at one or both ends of the tape slot 232, and/or other features as described above, alone or in any combination.

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

What is claimed is:

1. A slider body comprising:

a top plate having downwardly projecting top rails, the top plate coupled to a slider cap;

a bottom plate having upwardly projecting bottom rails;

a plate coupler coupled to the top plate and the bottom plate;

a joining section disposed between the top plate and the bottom plate to accommodate a zipper tape, the joining section having a length, and the slider cap having a length equal to or greater than 150% of the length of the joining section and defining an opening between the slider cap and the top plate that extends across a center of mass of the slider body along a first axis;

a pull tab coupled to the slider cap to move the slider body along the first axis to open or close a slide fastener, wherein the pull tab is movable within the opening along the first axis; and a protrusion projecting downward from the bottom plate to push an inner layer of material, which is coupled to the zipper tape, away from the joining section, wherein the protrusion has a height from the bottom plate that is substantially the same along an entire length of the protrusion, and wherein an outer surface of the protrusion forms a continuous structure with the bottom plate but does not form a hole or passage through the protrusion.

2. The slider body of claim 1, wherein the protrusion and the bottom plate are a single piece.

3. A slider body comprising:

a top plate having downwardly projecting top rails, the top plate coupled to a slider cap, the slider cap defining an opening between the slider cap and the top plate that extends across a center of mass of the slider body;

a bottom plate having upwardly projecting bottom rails;

a plate coupler coupled to the top plate and the bottom plate;

a joining section disposed between the top plate and the bottom plate to accommodate a zipper tape; and a protrusion projecting downward from the bottom plate to push an inner layer of material, which is coupled to the zipper tape, away from the joining section, said protrusion having a leading edge that projects from an anterior portion of the slider body and a trailing edge that projects from a posterior portion of the slider body, wherein the leading and trailing edges are oriented orthogonally with respect to an upper surface of the bottom plate, wherein the protrusion has a height from the bottom plate that is substantially the same along an entire length of the protrusion, and wherein an outer surface of the protrusion forms a continuous structure with the bottom plate but does not form a hole or passage through the protrusion.

4. The slider body of claim 3, wherein the protrusion projects vertically from the bottom plate.

5. The slider body of claim 3, wherein the joining section has a length, and wherein the slider cap has a length equal to or greater than 150% of the length of the joining section.

* * * * *